United States Patent [19]

Jamieson

[11] 4,044,702

[45] Aug. 30, 1977

[54] HIGH EFFICIENCY AERODYNAMIC SAIL SYSTEM FOR BOATS, AND METHOD FOR SAILING

[76] Inventor: Robert S. Jamieson, 411 N. Bush, Anaheim, Calif. 92805

[21] Appl. No.: 516,166

[22] Filed: Oct. 21, 1974

[51] Int. Cl.[2] ..... B63H 9/04

[52] U.S. Cl. ..... 114/102; 114/39; 114/90; 114/103; 114/109

[58] Field of Search ..... 114/39, 89, 90, 91, 114/97, 98, 102, 103, 108, 109, 123, 61; 280/213

[56] References Cited

U.S. PATENT DOCUMENTS

| | | | |
|---|---|---|---|
| 1,613,890 | 1/1927 | Herreshoff | 114/90 |
| 2,364,578 | 12/1944 | Wilkie | 114/39 |
| 2,724,356 | 11/1955 | Szakacs | 114/102 |
| 2,944,505 | 7/1960 | Berge | 114/39 |
| 3,120,211 | 2/1964 | Mahan | 114/102 |
| 3,168,068 | 2/1965 | Lasko et al. | 114/102 |
| 3,173,395 | 3/1965 | Laurent | 114/102 |
| 3,345,969 | 10/1967 | Purvis | 114/102 |
| 3,557,733 | 1/1971 | Mathieu et al. | 114/102 |
| 3,581,698 | 6/1971 | Bete | 114/103 |
| 3,626,883 | 12/1971 | Ellis | 114/102 |
| 3,802,373 | 4/1974 | Lagerquist | 114/102 |
| 3,889,620 | 6/1975 | Dorland | 114/39 |
| 3,933,110 | 1/1976 | Jamieson | 114/39 |

*Primary Examiner*—Trygve M. Blix
*Assistant Examiner*—Charles E. Frankfort

[57] ABSTRACT

A high efficiency aerodynamic sail system for boats comprises a triangular fabric sail pivotally suspended at its head from the apex of a tripod mast structure such that air impinging upon the luff of the sail is free from the turbulent wake of any upwind structure. The foot of the sail is attached only at its tack and clew ends to opposite ends of a spar which is pivotally attached at its center to a short stub mast centrally positioned in respect to the tripod mast. The sail luff and leech side deflections are caused to be identical by cables to provide a constant angle of attack of the sail to the wind along the entire sail height. A sail-shaping batten having a longitudinally varying cross section is employed along the foot of the sail. Loading of the batten by pressure generated by the wind causes the batten, and thus the sail, to assume an optimum airfoil shape. The sail luff and leech are cut to the deflection shape of the luff and leech cables, respectively, to assure a substantially constant camber along the entire height of the sail. In two variations the sail head is hung from a conventional single mast. In the first variation the sail tack and the sail clew are attached to opposite ends of a boom, the tack end of which is pivotally attached to one end of a second, shorter boom, which is, at its other end, rotatably attached to the mast. The sail may be positioned aweather of the mast to create a slot effect between the sail and the mast. In the second variation the sail tack is attached to one end of a short boom and the sail clew is attached at one end of a second, longer boom. The other ends of both booms are rotatably attached to the mast.

39 Claims, 15 Drawing Figures

HIGH EFFICIENCY AERODYNAMIC SAIL SYSTEM FOR BOATS, AND METHOD FOR SAILING

BACKGROUND OF THE INVENTION

1. Field of the Invention

This invention relates to the field of sails for boats and more particularly relates to sails having leading edges free from turbulent wake of upwind structures and having edge deflection restricting means constraining the sails to assume optimal airfoil shapes without twist.

2. Description of Prior Art

For centuries attempts have been made to improve the sailing characteristics and efficiency of sailing vessels. Such attempts still continue, receiving additional impetus by the popularity of sailboats for sport and recreation. Because there is a limit to the amount of sail a hull of a given size can carry, a considerable amount of attention has understandably been directed to improving sail efficiency.

The physics of sailing teaches that the propulsive force of sails, when sailing close to the wind, is derived more from horizontal sail lift than from push. Inasmuch as a sail acts much like an airplane wing, it follows that, for optimum efficiency, it should either be in the shape of, or constrained to assume a shape similar to, an airplane wing. Stated otherwise, the sails should have, or should assume under load, the cross section of a cambered airfoil.

Aerodynamic theory teaches that the flow of air impinging on an airfoil should be at a constant angle of attack along the leading edge of the airfoil, for optimum generation of lift. Airplane wings are made without twist; a desirable characteristic hitherto not achieved in sails, except for those downwind sails operating under regimes of fully-stalled airflow and not generating lift. Conventional mainsails of good design, well set, exhibit minimum twist angles of as much as half the difference between zero incidence and that incident angle at which stall begins. Only a portion of such sails can be set to a desired angle of attack of the incident wind.

A school of thought has developed which holds that twist is desirable, believing that since wind velocities aloft are sometimes greater than those below, lower angles of attack aloft compensate well for this velocity gradient. It would be easy to expand this reasoning to the absurd by advocating that sails be set just at stall along the foot and at zero incidence at the head. A more sensible approach would be to eliminate twist and design for smaller camber aloft, delaying flow separation while still generating lift aloft. Only when sails have readily-controllable twist is it possible to design for precise camber patterns with reasonable assurance that such patterns will usually be attained in use, for large amounts of twist will overcome the effects of precise camber control in the lofted sail.

Experience and testing teaches that any structure, such as a mast of circular section or even slender rigging, closely upstream or windward of the luff span of a sail causes a turbulent flow of air to impinge upon the sail and thereby considerably reduces sail lift. The angle of attack is defined as that angle between the flow of incident air and a straightline chord drawn between the leading edge of an airfoil section and the trailing edge in the plane of the airflow along that airfoil section. In a sail having curvature along the span, or height, the chords would most conveniently be drawn parallel to each other and the general direction of said airflow, to avoid complications caused by local variations in airflow direction resulting from curvature along the span, sail attachments and hardware, rigging and other adjacent objects, etc. The general variation of the angle of attack along the span of a sail — usually towards smaller angles near the head — is called twist. For optimum sail lift the impinging air flow should be laminar, rather than turbulent.

In attempts to improve sail efficiency, various patents have disclosed use of rigid airfoil sails, similar to airplane wings, mounted vertically or off from vertical on a hull (e.g. Barkla, U.S. Pat. No. 2,804,038 and Smith, U.S. Pat. No. 3,295,487).

Other patents employ a more conventional fabric sail which has a luff free from supporting structure. Simpson, U.S. Pat. No. 2,756,711 and Berge, U.S. Pat. No. 2,944,505, for example, employ a tripod mast. Laurent, U.S. Pat. No. 3,173,395 employs a conventional single mast having a pivotally mounted boom which rotates a triangular sail about the mast to keep the sail upwind of the mast. Ryder, U.S. Pat. No. 2,147,501 discloses a pair of inclined masts which rotate with the sail, the masts being supported by a short spar pivotally mounted on a stub mast. Ellis, U.S. Pat. No. 3,626,883, employs a thwartship track for sliding the tack to windward of his mast.

To prevent sail billowing Robin, U.S. Pat. No. 3,195,494 discloses a sail tautly stretched in a triangular frame which is pivotally supported by a derrick at its top corner and by a stub mast at its lower edge. At least one patent (Malrose, U.S. Pat. No. 3,112,725) employs a tautly stretched sail and multiple battens, also to prevent sail billowing.

These and similar sail systems have serious disadvantages, however. A rigid airfoil sail is impractical because the boat is either constrained to sail in only one direction, or else it must be symmetrical fore and aft and be turned around to change tack. Rigid airfoils cannot be adjusted to wind conditions and, because of their generally greater weight aloft, cause the craft on which they are mounted to be unstable.

The other structures generally provide no way to prevent unwanted sail billowing, or if they do, it is at the expense of having upwind structures adjacent to the sail luff. Many are structurally impractical and many employ inefficient fore and aft symmetry. None of these other structures cause the sail to assume an airfoil shape without twist.

Heretofore, to the applicant's knowledge, there has been no disclosure of a free hanging fabric sail, free from the turbulent wake of upwind structures, to which an optimum airfoil shape is imparted by a sail-shaping batten, the sail support being such that the sail assumes a substantially uniform shape from head to foot without twist.

SUMMARY OF THE INVENTION

In carrying out the principles of the present invention according to a preferred embodiment, a high efficiency aerodynamic sail system for boats comprises a sail supported only at its head, tack and clew in such manner that there is no structure positioned to introduce turbulent air flow onto the sail luff. Means are provided to restrict the sidewards deflections of both the sail luff and leech to cause the sail to present a constant angle of attack to the wind along its entire height. At least one sail-shaping batten, having longitudinally varying resistance to bending about a vertical axis, is provided along the foot of the sail to cause the sail to assume an optimum airfoil shape which, because of luff and leech countertensioning, is substantially constant along the entire height of the sail. A method of sailing is thereby provided comprising freely supporting a sail only at its corners, countertensioning the luff and leech and imparting an optimum airfoil shape to the sail by a sail-shaping batten.

More specifically, in one embodiment of the invention the head of a triangular sail is pivotally supported from the apex of a tripod mast structure, the legs of which are arranged in a generally triangular configuration on, for example, the interconnect structure of a tri-hull craft. The sail tack and clew are attached to opposite ends of a spar which is rotatably mounted atop a short stub mast centrally positioned in respect to the tripod mast structure. The sail luff and leech are countertensioned by deflection restricting elements between the spar attachment and said head. The leech deflection restricting element is movably attached to the spar to enable such element and sail leech to be moved, to vary the distance between the sail luff and leech, without directly affecting countertension from the element. A sail-shaping batten, having a longitudinally varying cross section, is installed along the foot of the sail, being secured at its ends to the luff and leech deflection restricting elements. When subjected to wind pressure and the pull of the sail, the batten bends into an optimum airfoil curve, inducing a similar curve into the sail.

In a first variation of the preferred embodiment, a conventional single mast which supports the head of the sail is adapted to pivotally support one end of a short boom. An end of a second longer boom is pivotally attached to the free end of the short boom. The sail tack and clew are attached to ends of the long boom, the former to that end of the long boom which is attached to the short boom. The short boom is rotatable about the mast to position the sail aweather of the mast in such relation thereto that a slot effect is created between the mast and sail to increase sail "lift". A rotatable, streamlined fairing sleeve is installed about the mast to prevent turbulence and reduce drag.

In a second variation of the preferred embodiment, the head of the sail is also supported from a conventional single mast. The mast is adapted for pivotal attachment of one end of a short boom and one end of a long boom for horizontal rotation of both booms about the mast. The sail tack is attached to the free, generally forwardly extending end of the short boom and the sail clew is attached to the free, generally rearwardly extending end of the longer boom in such manner that the mast is away from the luff of the sail. The sail may be positioned either aweather of the mast to create a slot effect to increase sail "lift" (as in the first variation), or it may be positioned alee of the mast with the luff clear of the mast wake.

In a third variation, a pair of similar sails, mounted in overlaying relationship, create an airfoil envelope with enhanced "lift".

DETAILED DESCRIPTION OF THE PREFERRED EMBODIMENT

GENERAL DESCRIPTION

Figure 1:
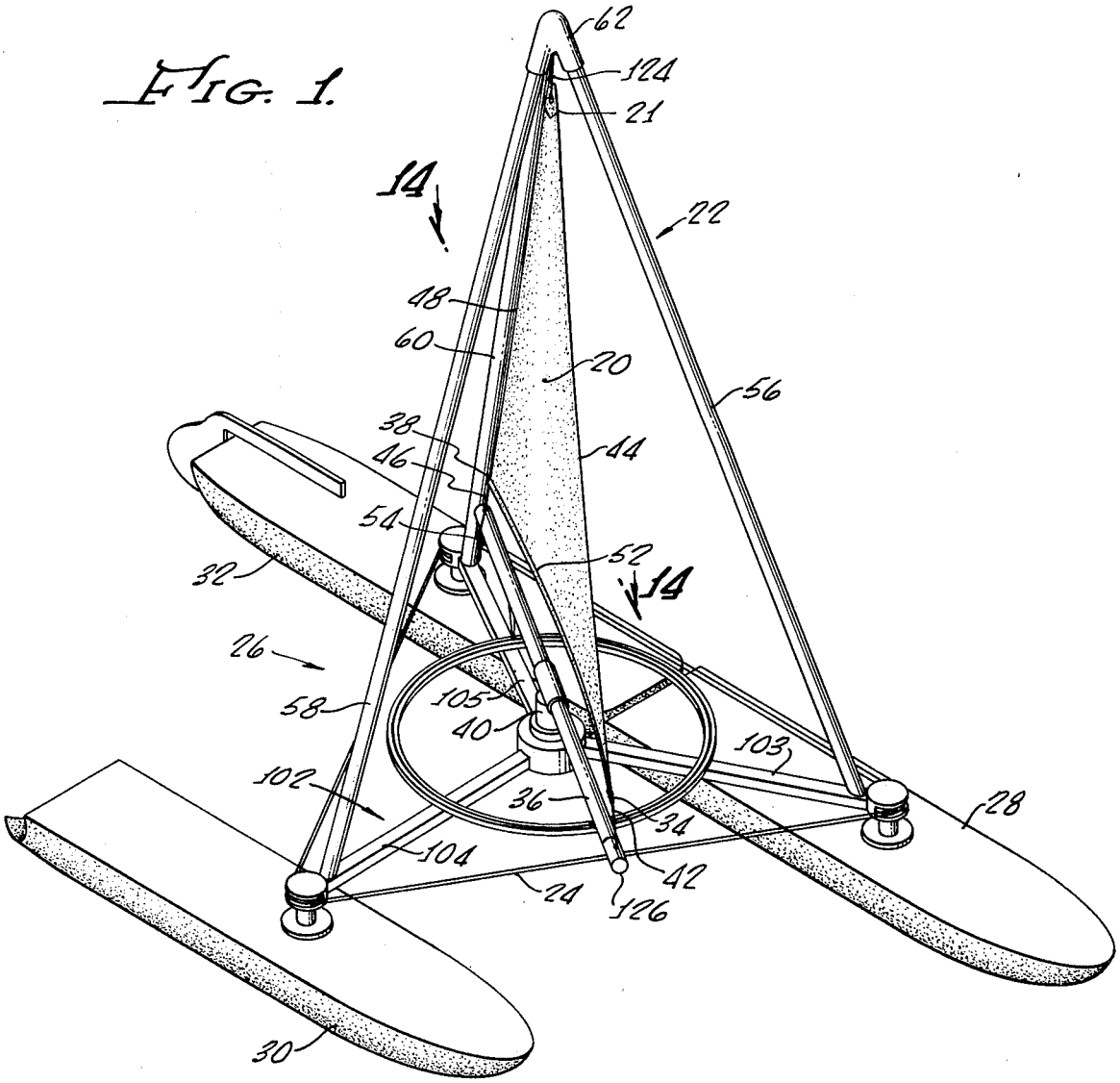
FIG. 1 is a perspective view showing the tripod mast of the preferred embodiment attached to the interconnect structure of a tri-hull sailboat.

A preferred embodiment of the invention, as best seen in FIG. 1, comprises a flexible, generally triangular sail 20 pivotally suspended at a head 21 from a tripod mast structure 22. The mast structure is mounted on a deck 24 (FIG. 7) of, for example, a tri-hull sailboat 26 having a pivotal first hull 28, a pivotal second hull 30 and a pivotal third hull 32. The sail 20 is attached at a tack (or lower forward) corner 34 to the forward end of what will be referred to as a spar 36, and at a clew (or after lower) corner 38 to the aft end of the spar 36. The spar 36 is preferably rotatably mounted, at its general center, atop a short, vertical stub mast 40 which is centrally located in respect to the tripod mast structure 22.

Figure 2:
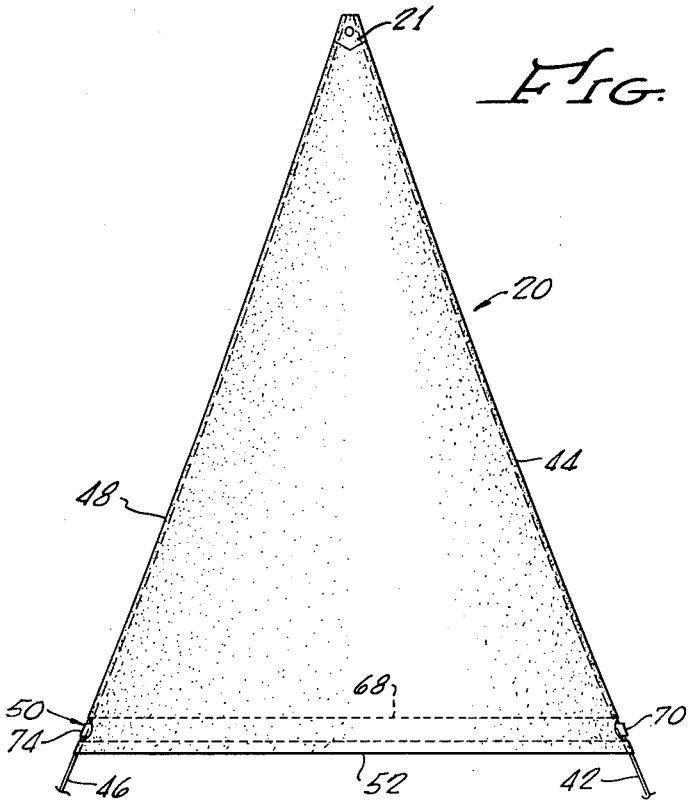
FIG. 2 is a side elevational view showing the sail.

A luff cable or deflection restricting element 42 (FIG. 2) countertensions a luff (or leading edge) 44 of sail 20 and a leech cable or deflection restricting element 46 countertensions a leech (or trailing edge) 48 of the sail, the luff and leech cables also being used for attaching the tack and clew corners of the sail to spar 36. A sail-shaping batten 50 (FIG. 2) is installed along a foot 52 of the sail and is attached at its ends to the luff and leech cables.

In this manner, the sail 20 is supported only at three points: the head 21, the tack corner 34 and the clew corner 38. Its luff 44, by virtue of the sail being suspended from the tripod mast structure 22, is clear of any sail supporting structure which could introduce a turbulent flow of air onto the luff of the sail. The spar 36, being shorter than the spacing between elements of the mast structure, is free to rotate about the top of stub mast 40 to enable optimum positioning of the sail luff in respect to the wind.

An optimum airfoil shape is imparted to sail 20, as more particularly described below, by batten 50 acting in cooperation with luff and leech cables 42 and 46, the luff and leech cables also constraining the entire height of the sail to present a constant angle of attack to the wind.

The camber of the sail (that is the ratio of the depth of curvature to the length of chord) is controlled by a clew outhaul 54, also as more particularly described below, which allows the spacing between the tack and the clew corners 34 and 38 (and thus the spacing between the sail luff and leech 44 and 48) to be changed without changing the tension of the luff and leech cables 42, 46.

The tripod mast structure 22 comprises a first mast 56, a second mast 58 and a third mast 60. Each mast is substantially identical and is inclined at an angle so that the masts meet at their upper ends, the masts being secured together as by being separately bolted to an end fitting 62. Each mast is secured to the deck 24, for example, by flanged deck fittings (not shown) into which the lower ends of the masts are inserted and bolted and which are in turn bolted to the deck (in the preferred embodiment, at the vertices of a triangular deck).

DESCRIPTION OF THE SAIL, SAIL-SHAPING BATTEN AND LUFF AND LEECH CABLES

The sail 20 and the sail-shaping batten 50, together with the luff and leech cables 42 and 46, form an important part of the embodiment. The entire sail, because of its shape and tensioning, under the action of batten 50 and cables 42 and 46, is constrained to assume a very efficient airfoil shape over a broad range of sailing conditions.

A conventional triangular mainsail is ordinarily cut fuller along the luff, the leech and the foot. That is, the edges are curved outwardly. When the sail is secured along the luff to a mast and along the foot to a boom — as is normaly done — the excess material along the edges allows a belly to be formed in the sail. A bellied sail creates more lift than does a flat sail.

In contrast, the foot 52 of sail 20 is preferably cut straight and the luff and leech 44 and 48 are cut in a manner removing material from the sail. That is, the luff and leech edges are curved inwardly (rather than outwardly). The luff and leech curvatures are such as to compensate for the deflection under load of the luff and leech cables 42 and 46. Under the action of sail forces, the luff and leech cables are deflected in a crosswind direction and are also pulled toward each other (as a result of sail billowing), the region of greatest deflection being at the moment center of sail effort (for a triangular sail 42.26% of the distance from the foot to the head). If the luff and leech of the sail were cut straight (or curved outwardly instead of inwardly) the sail would billow more in regions of greater luff and leech cable deflection. By cutting in proper relation to deflection of the luff and leech cables, the relative sail camber is substantially the same along the entire height of the sail, the camber being controllable by moving the sail luff and leech closer together or further apart (by means of the clew outhaul 54).

In this manner, the optimum camber for any particular sailing condition may be set by the clew outhaul 54 and the entire sail will have substantially this same optimum camber, there being no regions of deeper curvature of the sail. And, as the sail is constrained at only the ends of the foot, the sail is free to, and does, assume whatever shape is imparted to it by the batten 50 which is installed along the foot. As will be described below, under loading the batten flexes into an optimum airfoil shape and imparts this same airfoil shape to the entire sail, a cross section of the sail at any height having a substantially similar (although necessarily smaller as the sail narrows away from the foot) shape.

It is well known that a uniformly loaded, horizontally stretched cable sags or deflects into a catenary curve, the depth of the curve depending upon the constants of the cable, the distance between ends and the loading. In an analogous manner, the luff and leech cables deflect under the wind loading of the sail, but into a curve geometrically different from a catenary; for which I suggest the name of velanary. The triangular shape of the sail imparts a nonuniform, ramp loading to the cables, causing their curvatures to deviate from true catenary curves, the regions of deepest curvature being at the center of moments of the sail rather than at the center of the cable. There is not only the cable deflection perpendicular to the chord of the sail airfoil to be considered, but also cable deflection parallel to the airfoil chord as well because of the pull of the luff and leech of the sail as it tends to billow.

The luff and leech cable loadings are functions of the wind force, the angle of attack of the sail and the angles between the luff and the chord, and between the leech and the chord. It is necessary to derive a single curvature for the luff and leech of the sail for a particular typical set of parameters. Under this particular set of conditions, and with the sail edges cut to the complements of the cable deflection curves, the sail luff and leech curvatures will exactly match the luff and leech cable deflections and the sail will have a constant curvature from foot to head. At different conditions, the sail luff and leech will not exactly match the cable deflection, and the curvature of the sail will not be exactly constant from foot to head. By selecting a strong cable whose tension can be readjusted, and by selecting a typical or optimum sailing condition for determining the luff and leech curvature, this deviation can be made negligible and the sail curvature will be virtually constant from foot to head under most sailing conditions.

The following general equation for the deflection of a flexible element (for instance a cable) subjected to ramp loading, derived in a manner known to those skilled in the art, is used to calculate the curves to which the luff and leech 44, 48 of sail are cut:

$$y = Wb/6H\,(ax - x^3/a) \qquad (1)$$

In the foregoing equation $y$ is the perpendicular deflection (in feet) at any distance $x$ (in feet) along a straight line joining the two ends of the cable. The origin of the coordinates is at the head of the sail, such that only positive values of $x$ and $y$ are used. For reasons of simplicity $x$ is vertical; departures of cables from the vertical can be easily treated by the relationships of trigonometry. W is the wind loading on the sail (in psf), $b$ is the length of the foot of the sail (in feet), $a$ is the vertical distance between the sail head and foot of either the luff or leech (depending upon which curve is being calculated) (in feet) and H is the vertical component of cable tension (in pounds). A later example will illustrate use of equation (1).

After the sail luff and leech have been cut to the shape determined by use of equation (1), the luff and leech cables 42 and 46 are sewn into pockets or seams, or otherwise securely connected to, the luff 44 and leech 48, respectively, and the fabric of the luff and leech downhauled by conventional means (not shown) so that the sail will not slide along the cables or wrinkle.

A batten pocket 68 (FIG. 2) to contain batten 50 is formed along the entire length of the foot 52 of sail 20. The preferred embodiment employs only a single batten 50 and hence requires only a single batten pocket 68. However, the scope of the invention includes, for example in larger sails, use of more than one batten similar to batten 50 and hence use of plural batten pockets similar to batten pocket 68, which pockets may be located at various elevations along the height of the sail.

Figure 3:
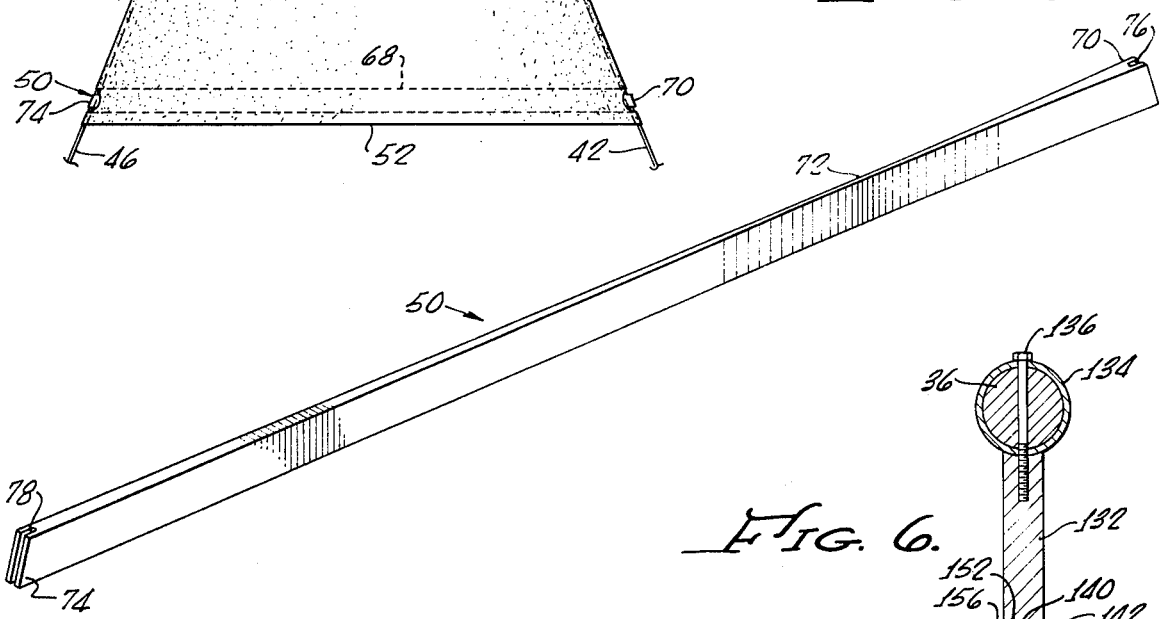
FIG. 3 is an isometric view showing the sail-shaping batten.
Figure 6:
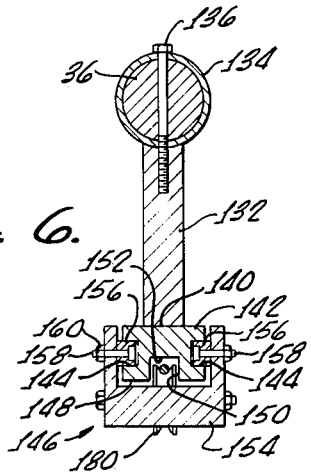
FIG. 6 is a sectional view along line 6—6 of FIG. 5, showing the clew outhaul.

As seen in FIG. 3, batten 50 comprises a slender, flexible element of rectangular cross-section, being substantially wider than it is thick. The thickness of the batten 50 is varied along its length such that instead of bending into an arc of a circle when it is flexed, it bends into an optimum airfoil shape. To this end, the thickness is tapered from an end 70 to a minimum at a region 72 which is approximately one-fourth to one-third of the length of the batten from end 70. From region 72 to an opposite end 74 the thickness is smoothly increased such that the end 74 is substantially the same thickness as end 70.

End 70 has a vertical slot 76, and end 74 has a similar slot 78, adapted for receiving luff cable 42 and leech cable 46, respectively, when the batten is flexed. Slots 76 and 78 are of a sufficient depth to prevent the cables from slipping from the batten. The bottoms of slots 76 and 78 are cut at angles matching the side angles of the sail in the region of the sail foot. The distance between the bottoms of the two slots (along the batten) is equal to the spacing between the luff and leech of the sail at the batten pocket 68. Upon installation, the batten 50 is inserted into batten pocket 68 (FIG. 2) with the luff and leech cables inserted into slots 76 and 78 respectively.

Figure 14:
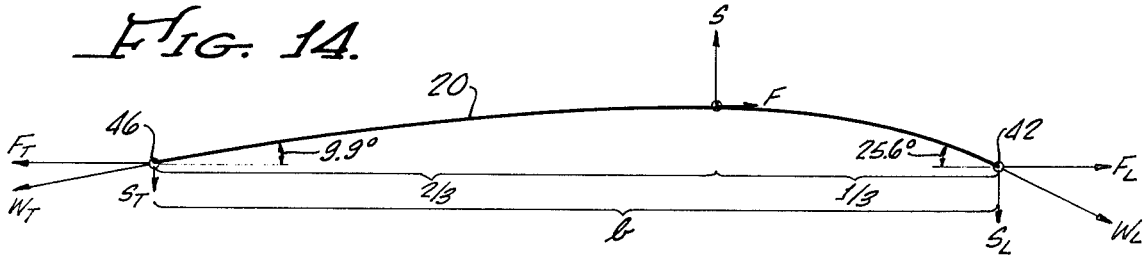
FIG. 14 is a horizontal sectional view along line 14—14 of FIG. 1 showing cable forces.

The luff and leech cables 42 and 46 may be formed as sections of a single length of cable which is curved around the head 21 of sail 20 so that one portion of the cable forms luff cable 42 and another portion forms leech cable 46. The luff and leech cables, if they are common to a single length of cable, will not usually be at the same tension. However, the luff and leech cables may alternatively be separate and may each terminate at the head 21 of the sail, being separately secured thereto by use of conventional cable terminating means, not shown. Use of separate luff and leech cables allows separate cable tensioning which is desirable if the sail shape deviates substantially from equal angles of the luff and leech to the chord, as depicted in FIG. 14.

DESCRIPTION OF THE SPAR ATTACHMENT

The spar 36 is preferably rotatably attached to the stub mast 40 to allow rotation of the spar about the stub mast to position the luff of sail 20 according to the direction of travel of the craft and the direction of the wind.

Figure 4:
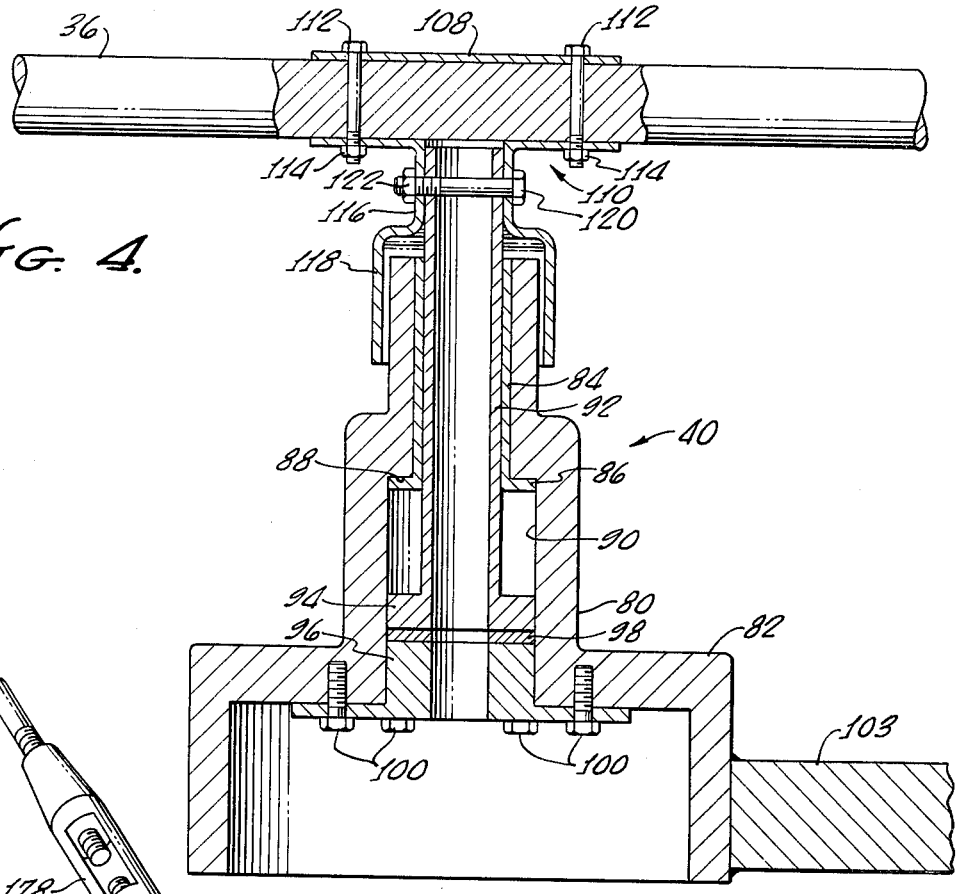
FIG. 4 is a partial vertical sectional view showing the boom-to-stub mast attachment.
Figure 5:
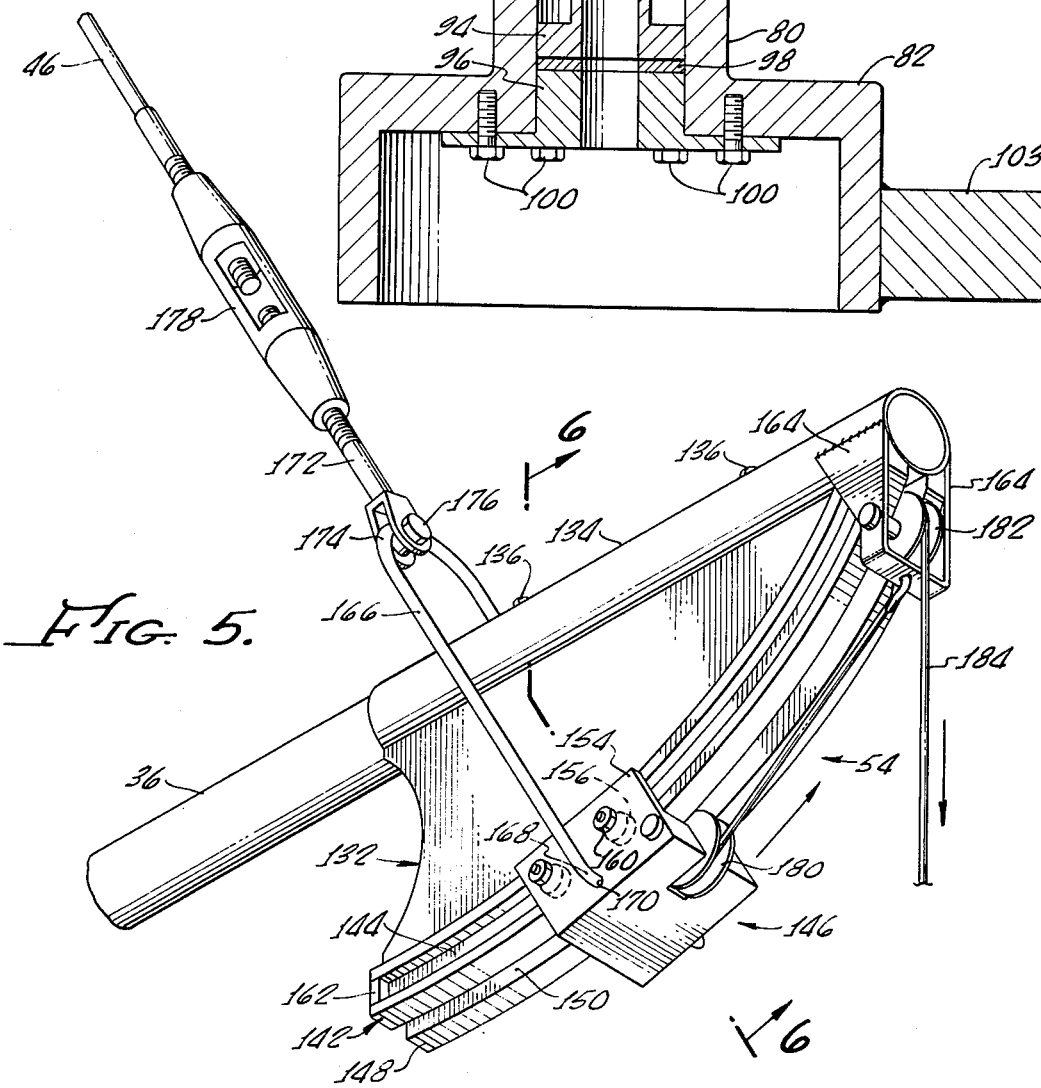
FIG. 5 is a perspective view showing the leech cable outhaul at the aft end of the spar or boom.

FIG. 4 is exemplary of one means for pivotally attaching spar 36 to stub mast 40. Stub mast 40 comprises a hollow housing 80 terminating in a relatively large diameter cylindrical region 82 at a lower end. Housing 80 is internally press fit with a tubular bushing 84 which terminates at its lower end in a flange 86, the upper surface of which seats against a shoulder 88 of an inner diameter region 90 of housing 80.

A cylindrical axle 92, terminating in a lower circular flange 94, substantially the same diameter of flange 86 of bushing 84, is rotatably installed within bushing 84 such that at an upper extreme of travel the upper surface of flange 94 bears against the lower surface of flange 86 to restrain the axle against further upward movement. A retainer 96 near the lower end of housing 80 limits downward travel of axle 92. A bearing disc 98 is provided adjacent to the upper surface of retainer 96. Retainer 96 is secured internally to housing 80 by bolts 100 which pass through retainer 96 and are threaded into housing 80. In this manner the axle 92, and consequently spar 36 to which the axle is attached (as described below), is allowed vertical movement, over a restricted range, as is desirable for tensioning of the luff and leech cables (also as described below).

The region 82 of stub mast 40 forms, for example, the central hub of an interconnect structure 102 (comprising arms 103, 104 and 105), shown in FIG. 1.

In order to attach the spar 36 to the stub mast 40, a sleeve 108 of a fitting 110 is closely fit over the spar at its center and is attached thereto by bolts 112 and nuts 114.

A vertical sleeve 116, internally adapted to fit over the upwardly projecting end of axle 92, is joined to sleeve 110. Sleeve 116, outwardly flared at a lower region 118 to cover, upon assembly, the upper end of the stub mast 40 to keep out water and dirt, is attached to axle 92 by a bolt 120 and a nut 122.

DESCRIPTION OF THE SAIL ATTACHMENT AND CONTROLS

The head 21 of sail 20 is pivotally suspended from mast fitting 62 in a conventional manner by a swivel fitting 124 (FIG. 1). The sail is raised by a conventional halyard (not shown).

The lower ends of luff and leech cables 42 and 46 are attached to opposite ends of spar 36 as shown in FIGS. 1, 5 6 and 7. The lower end of luff cable 42 may be attached to a fitting 126 on the forward end of the spar in a conventional manner, as by use of a clevis 128. A turnbuckle 130 for adjusting cable tension is provided between the clevis and the cable. The lower end of leech cable 46 is movably attached to the clew outhaul 54 (FIGS. 5 and 6) such that the lower end of the cable 46 may be moved in the general plane of the sail and the spar to bring the sail luff and leech closer together or move them further apart. When the luff and leech are moved closer together, batten 50 is flexed to a greater degree and the sail is caused to assume a deeper airfoil curvature. Conversely, when the luff and leech cables are moved apart, the batten unflexes, thereby causing a decrease in the depth of sail curvature.

In order that the leech cable 46 may be moved without directly affecting its tensioning, (that is, neglecting sail forces) the lower end of the leech cable is caused to move in an arc having a center of radius at the head of the sail. To this end, the clew outhaul 54 includes a generally arcuate, somewhat wedge-shaped element 132 joined to a tubular sleeve 134 which closely fits over the aft end of spar 36 and is attached thereby by bolts 136. The bottom surface 140 of element 132 is convex downwardly in an arc having a center of radius at the head of the sail.

An arcuate track 142, attached to an arcuate bottom surface 140 of element 132, has an elongate arcuate recess 144 of rectangular cross section on each side adapted to receive a wheeled element or trolley 146. Recesses 144 also have a radius of curvature located at the head of the sail. A bottom surface 148 of track 142 has an elongate, arcuate central recess 150 to provide cable and pulley clearance, as described below. An inner surface 152 of recess 150 also has a curvature whose center of radius is at the head of the sail.

The trolley 146 includes a U-shaped element 154 having an inner width sufficient to fit over sides of track 142. Four wheels 156, two spaced apart on each leg of element 154, are positioned to fit within recesses 144, thereby constraining trolley 146 to travel along track 142. Wheels 156 are attached to element 154 by bolts 158 and nuts 160. The trolley is prevented from leaving the ends of recess 144 by a stop 162 at the forward end of the track (attached thereto by screws, not shown) and a pair of ears 164 (to be described below) at the aft end of track 142.

The leech cable 46 is attached to element 154 by an oblong loop 166 whose lower end 168 passes through a lateral hole 170 in element 154. A clevis 172 at the lower end of the leech cable 46 is attached to an upper arcuate end 174 of loop 166 by a bolt 176 and nut (not shown). The loop 166 encircles the clew outhaul 54 to allow an upward pull to be transmitted to trolley 146 by the leech cable. The leech cable is provided with a turnbuckle 178 adjacent clevis 172 for tensioning the leech cable.

Wind forces acting on sail 20 tend to cause the sail to billow and thereby pull the leech cable 46 toward the luff cable 42 (by sliding the trolley 146 along the track 142). It is therefore unnecessary to otherwise provide for pulling the trolley 146 in a forward direction. To provide for pulling trolley 146 toward the end of spar 36, a pulley 180 is mounted at the aft end of element 146 and a similar pulley 182 is mounted between ears 164 in such manner that both pulleys are aligned and are in a generally vertical plane. A cable 184 interconnects the two pulleys, a pull on the free end thereof pulling trolley 146 aft, thereby increasing the separation between the luff and leech cables. Under sailing conditions, releasing tension on cable 184 allows the sail to pull the trolley 146 forwardly to bring the luff and leech closer together.

Figure 7:
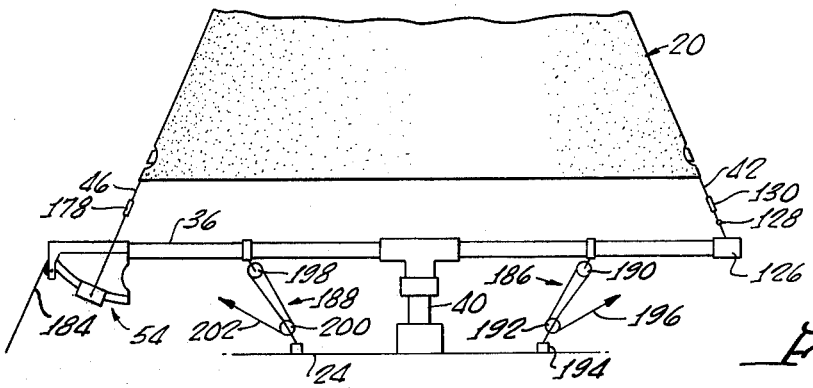
FIG. 7 is a side elevational view showing the spar and boom downhauls.

As best seen in FIG. 7, vertical and rotational positioning of spar 36 is by a forward downhaul 186 and an aft downhaul 188. The forward downhaul 186 comprises a pulley 190 pivotally attached to spar 36 and a pulley 192 pivotally and slidably attached to a circular track 194 which is mounted on deck 24 or other hull structure so as to be concentric with the center of rotation of the spar 36. A cable 196 interconnects pulleys 190 and 192. Similarly, the aft downhaul 188 comprises a pulley 198 pivotally attached to an after region of the spar 36, a pulley 200 pivotally and slidably attached to track 194, and a cable 202 interconnecting pulleys 198 and 200.

Pulling on cables 196 and 202, rigged to exert a downward pull on spar 36, tautens the sail by tensioning the luff and leech cables 42 and 46. Further cable tension adjustments are made by tightening or loosening the turnbuckles 130 and 178 adjacent to the lower ends of the luff and leech cables, respectively.

Because of the slidable attachment on circular track 194 of pulleys 192 and 200 of the forward and aft spar downhauls 186, 188, the spar 36 may be rotated about the stub mast 40 as necessary to position the sail relative to the wind without releasing or changing tension in cables 196 and 202.

Alternatively, particularly on craft having a small spar 36, the downhauls 186, 188 alone may be used to control the positioning of the spar, with such spar free instead of attached to the stub mast 40, the stub mast being eliminated to reduce complexity and costs.

Although the luff cable 42 is shown and described as fixed to the forward end of the spar 36, it may be movably attached thereto in a manner similar to that described for attaching the leech cable 46 to the spar.

OPERATION OF THE PREFERRED EMBODIMENT

Sail 20 is hung from the tripod mast support 22 and is attached to the spar 36 by luff and leech cables 42 and 46. The sail-shaping batten 50 is inserted in the sail batten pocket 68 with slots 76 and 78 of the batten engaging the luff and leech cables, respectively. The desired depth of curvature of the sail is achieved by suitable fore-aft positioning of the trolley 146, to which the leech cable is attached. The batten 50 is flexed against the axially compressive forces imparted to it by the luff and leech cables and bends into the outline of a cambered airfoil, thereby also causing the sail to assume an optimum airfoil cross section. Because the sail is not secured to any structure along the luff edge, the sail is assured of an undisturbed flow of air along its entire leading edge.

The luff and leech cables 42, 46 are tensioned by spar downhauls 186 and 188. The luff edge of the sail is presented at an angle to the wind appropriate for the sailing direction and wind conditions. Thereafter, the degree of sail curvature is controlled as may be desired by the clew outhaul cable 184 and the spar downhaul cables 196 and 202. Sailing is otherwise performed in a conventional manner.

The above-described embodiment is particularly adaptable, because of the tripod mast structure 22, to a plural hull craft such as a tri-hull boat which provides a broad platform or deck to which lower ends of the tripod masts may be attached. It may, however, be desirable to adapt sail 20 to a conventional single mast of a single-hull craft. A first and second variation of the preferred embodiment illustrate and describe such adaptations.

FIRST VARIATION OF THE PREFERRED EMBODIMENT

Figure 8:
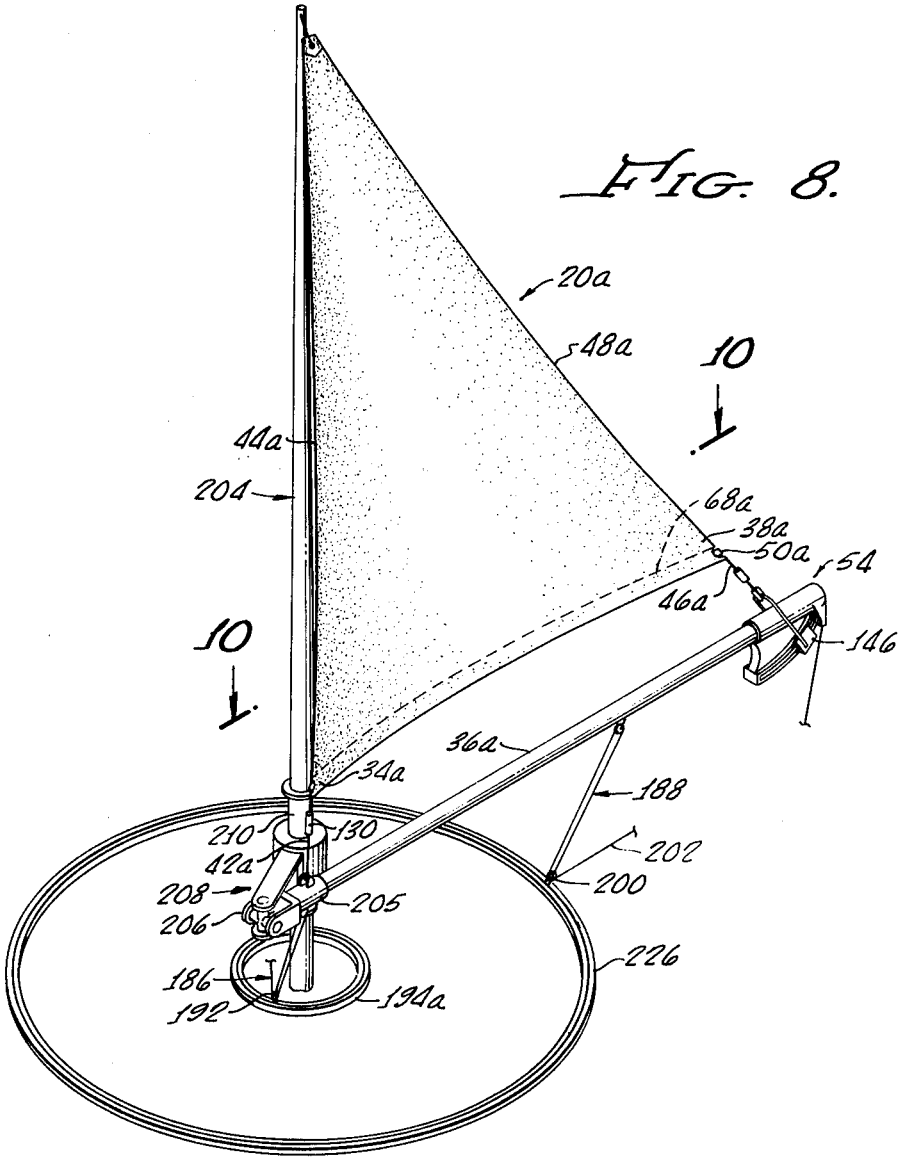
FIG. 8 is a perspective view of a first variation of the preferred embodiment showing the sail attached to a conventional mast and to a long boom which is pivotally attached to a short rotating boom.

As shown in FIG. 8, a sail **20*a*, having a sail-shaping batten 50*a* in a batten pocket 68*a*, is pivotally suspended at its head from a single, generally vertical, conventional mast 204. It is also attached at its tack and clew corners 34*a* and 38*a* to the forward and aft ends of a boom 36*a* (corresponding to the spar 36) by luff and leech cables 42*a* and 46*a*, respectively. The leech cable is attached to a movable trolley 146 and on a clew outhaul 54 at the aft end of the boom 36*a*.**

Figure 9:
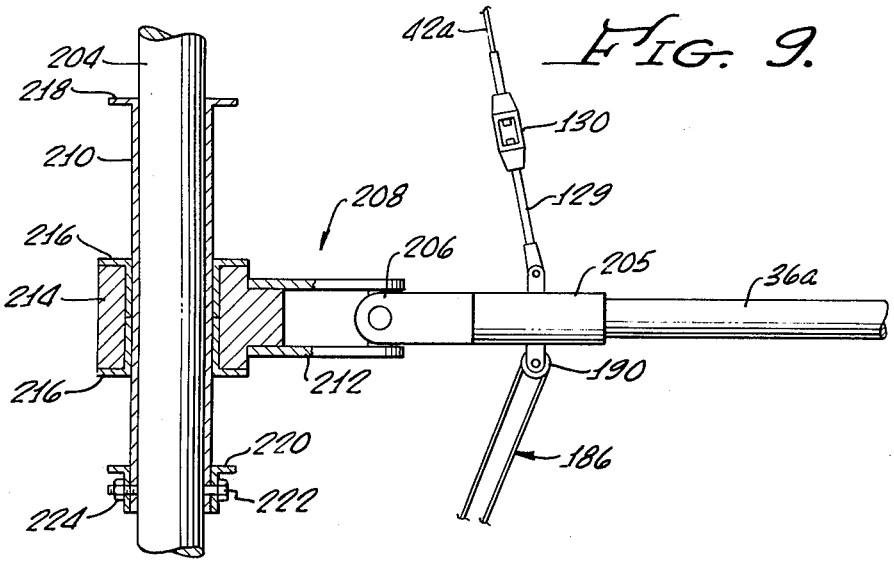
FIG. 9 is a partial vertical sectional view showing the attachment of the long boom to the short boom, and mast attachment of the short boom.

An end fitting 205 at the forward end of boom **36*a* is pivotally attached, by a universal joint 206, to one end of a short boom or boomlet 208. The other end of the boomlet 208 is rotatably mounted to mast 204, a lower region of which is adapted for mounting boomlet 208 by installation of an exterior tubular sleeve 210 about which the boomlet rotates (FIG. 9**).

Boomlet 208 comprises a horizontal arm 212, joined to a vertical cylindrical sleeve 214. A two-piece tubular, flanged bearing 216 is press fit into the inner diameter of sleeve 214 and fits closely over sleeve 210.

The axial length of sleeve 210 is greater than that of sleeve 214 of the boomlet and bearing 216 so that the boomlet may not only rotate about the mast, but may also slide up and down the mast a controlled distance for tensioning of sail 20*a*. A projecting flange 218 at the upper end of sleeve 210 limits movement of the boomlet in an upward direction and a detachable flange 220 at the lower end of sleeve 210 limits movement of the boomlet in a downward direction. The flange 220 and sleeve 210 are secured to the mast by a bolt 222 and a nut 224. Flanges 218 and 220 are such that a smooth surface is presented to the flanges of bearing 216 so that the boomlet may be easily rotated even when in contact with either of the aforementioned flanges.

Because only a single mast 204 is used, the sail 20*a* is more nearly shaped like a conventional single sail. That is, its shape is more nearly a right triangle (rather than being in the shape of an isosceles triangle, as was described for sail 20). The construction of sail 20*a* is, however, otherwise identical to that of sail 20, the luff and leech edges 44*a* and 48*a* being cut to compensate for the deflection of luff and leech cables 42*a* and 46*a*.

Tensioning of the sail 20*a* and the luff and leech cables 42*a* and 46*a* is provided by forward and aft downhauls 186 and 188, the former being attached to the end fitting 205 at the forward end of boom 36*a*, and the latter being attached towards the aft end of the boom.

A lower pulley 192 of the forward downhaul is pivotally and slidably attached to a circular track 194*a* which is mounted concentrically with mast 204 (on a deck, not shown). A lower pulley 200 of the aft downhaul is pivotally and slidably attached to an arcuate section of track 226 which, although concentric with track 194*a* (and also attached to the deck), does not necessarily continue in a complete circle about the mast.

OPERATION OF THE FIRST VARIATION OF THE PREFERRED EMBODIMENT

Figure 10:
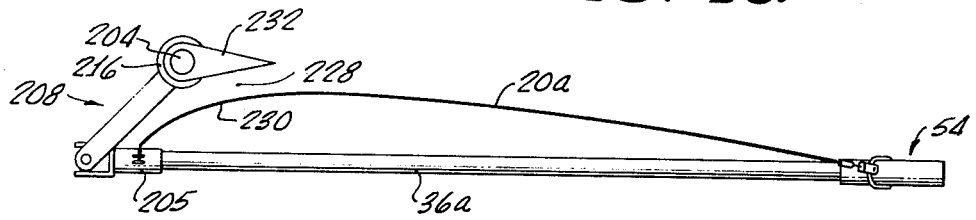
FIG. 10 is a horizontal sectional view along line 10—10 of FIG. 8 showing positioning of the sail and mast to create a slot effect.

After the sail 20*a* has been attached to the mast 204 and the boom 36*a*, and the sail and luff and leech cables 42*a* and 46*a* have been tensioned by the downhauls 186 and 188 (in the manner previously described for the preferred embodiment) the boomlet 208 is rotated about the mast 204 and the boom 36*a* is positioned so the leading portion of the sail is aweather of the mast, as seen in FIG. 10. In this position, the luff 44*a* of the sail is forward and aweather of the mast 210 and is hence completely free from the turbulent wake of the mast.

A very important effect (heretofore, to the applicant's knowledge, unapplied as to sailboats) of this aweather positioning of the sail 20*a* in respect to mast 204 is creation of a "slot effect" in a region 228 between the sail and the mast. This "slot effect" (assuming positioning of the mast near a center of lift 230 of the sail by an appropriate length of boomlet 208) increases the "lift" of the sail by compressing the air flow near the center of lift, a phenomena frequently utilized in airplanes. The result is produced in non-streamlined masts by installing a rotatable, streamlined fairing 232 (FIG. 10) on the mast to assure a laminar flow of air between the mast and the sail (not shown in FIGS. 8 and 9).

By appropriate rotation of the boomlet 208 and the boom 36*a*, the sail may alternatively be positioned alee of the mast (not shown). However, the beneficial "slot effect" is lost when the sail is in this position.

Figure 11:
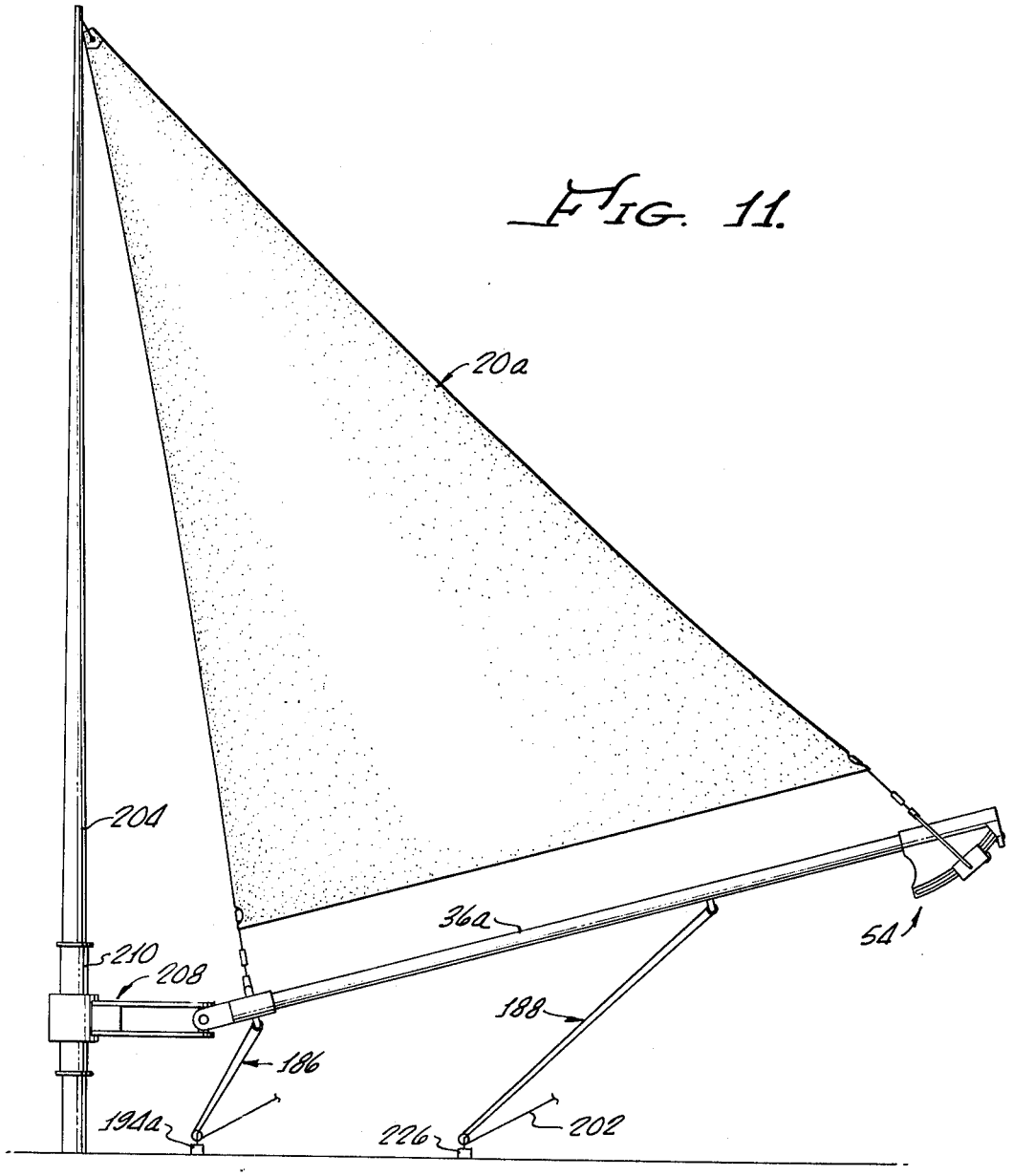
FIG. 11 is a side elevational view showing rearward positioning of the sail during course changing.

When changing tack, the boomlet 208 is pivoted rearwardly about the mast 204 in order to reposition the sail from one side of the mast to the other. This sail repositioning raises the aft end of boom 36*a* (FIG. 11). Thus, in repositioning the sail it is necessary to release the tension of cable 202 of the aft downhaul 188 to allow the aft end of the boom to rise.

A craft utilizing this first variation sail system is otherwise sailed in the manner previously described.

SECOND VARIATION OF THE PREFERRED EMBODIMENT

Figure 12:
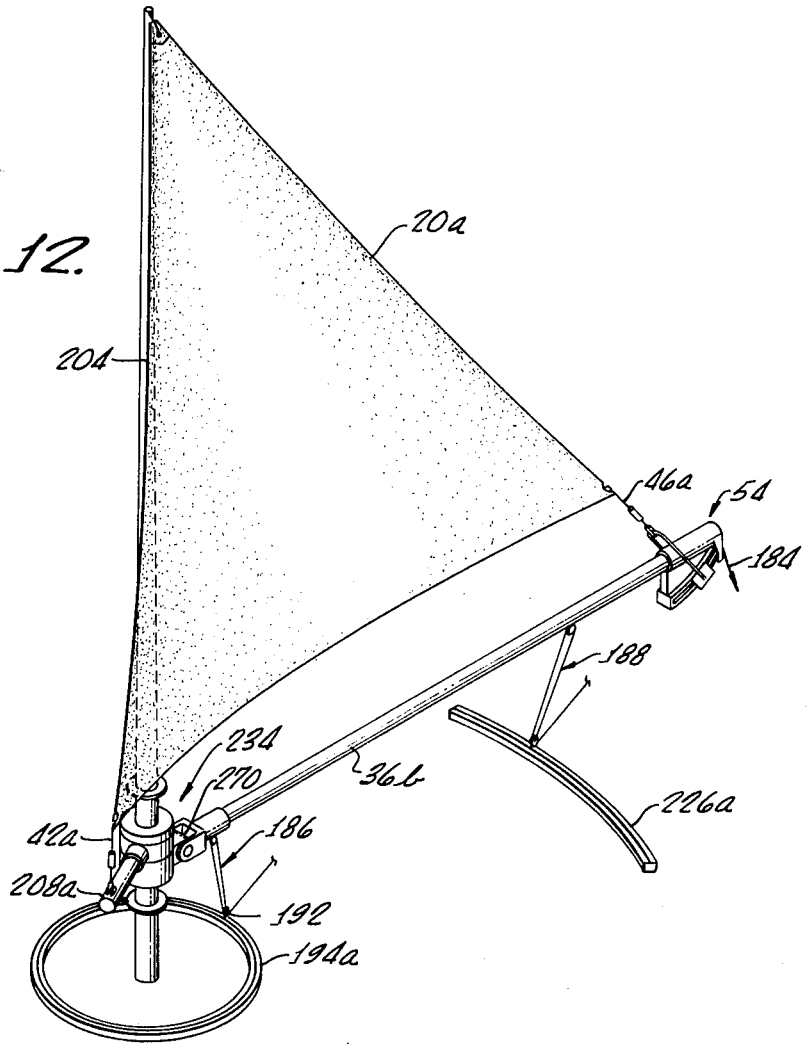
FIG. 12 is a perspective view of a second variation of the preferred embodiment showing the sail attached to a conventional mast and to ends of a long and short boom.

As seen in FIG. 12, the second variation of the preferred embodiment is similar to the first variation described above. A sail 20*a* is supported by a single conventional mast 204 and a short boom or boomlet 208*a* and a boom 36*b* are used to attach lower ends of a luff cable 42*a* and a leech cable 46*a*. A forward and aft downhaul 186 and 188 are employed to tension the sail and the luff and leech cables.

However, the boomlet 208*a* and the boom 36*b* are not attached to one another in this variation. Each is instead separately attached to a mast fitting 234 which is free to rotate about, as well as slide up and down upon, the sleeve 210 which is fit around a lower region of the mast. The boom and boomlet may thus be rotated about the mast either separately or in unison.

Figure 13:
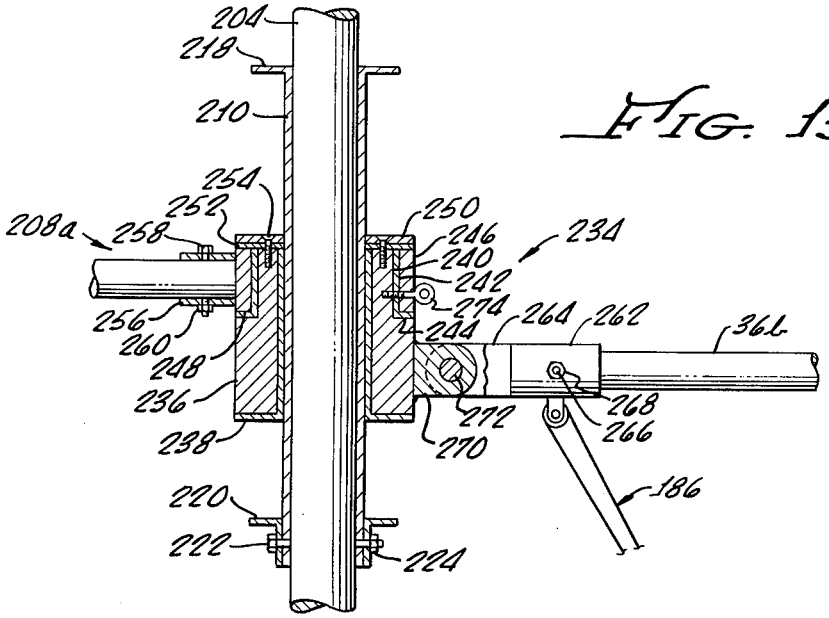
FIG. 13 is a partial vertical sectional view showing the rotational attachment of the long and short booms of FIG. 12 to the mast.

As seen in FIG. 13, the mast fitting 234 includes a generally cylindrical sleeve 236 having a flanged tubular bearing 238 internally press fit therein, bearing 238 fitting closely over sleeve 210. The outer diameter of sleeve 236 is inwardly stepped at an upper region 240. A flanged tubular bearing 242 is press fit over region 240, a lower surface 244 of the flange seating against an internal shoulder of sleeve 236 at the diameter change.

A mounting sleeve 246 closely fits over bearing 242. A lower surface 248 of sleeve 246 seats against the upper surface of the bearing 242 flange. Sleeve 246 is constrained against upward movement by a retaining ring 250, separated from sleeve 246 by a bearing ring 252. Ring 250 is held in position by a number of countersunk bolts 254 threaded into sleeve 236. Boomlet 208*a* is inserted in a socket 256 of sleeve 246 and is secured therein by a bolt 258 and a nut 260.

Boom 36*b* is pivotally attached to sleeve 236 for pivotal movement in a vertical plane. A boom end fitting 262, having a pair of projecting ears 264, is attached to the forward end of boom 36*b* by a bolt 266 and a nut 268. An ear or tang 270 projecting from sleeve 236 is positioned vertically between ears 264 of fitting 262 and is attached thereto by a bolt 272.

This method of attachment allows boom 36*b* to be rotated about sleeve 210 and the boomlet 208 to be independently rotated about the fitting 234. The boom 36*b* and boomlet 208*a* may thus be positioned at any desired angle to each other. A locking pin 274, insertable through holes in sleeve 246 into holes in sleeve 236, locks the boom and boomlet together for movement in unison.

OPERATION OF THE SECOND VARIATION OF THE PREFERRED EMBODIMENT

The boom 36*b* and boomlet 208*a* may be aligned with the boomlet pointing generally forwardly and the boom 36*b* pointing generally aft to position sail 20*a* aweather of the mast 204 to create the above-described slot effect between the mast and the sail. Alternatively, the sail 20*a* may be positioned alee of the mast 204.

To move the sail from one side of the mast to the other, the boomlet 208*a* is swung into the sail while pulling the clew outhaul cable 184 as far aft as possible. As rotating the boomlet 208*a* into the sail causes the sail-shaping batten (not shown) to flex a considerable amount, the batten must be sufficiently flexible and the boomlet must be sufficiently short so that the batten does not break. The boomlet 208a may also be rotated away from the boom 36 in a manner causing outhauling of the tack of the sail to thereby vary the spacing between the sail tack and clew.

It is unnecessary to release the tension of either the forward downhaul 186 (attached to track 194a) or the after downhaul 188 (attached to a track 226a) as the boom 36b is not raised when the sail is moved from one side of the mast to the other.

It will be seen that the variations of both FIGS. 8 and 12 include a relatively long boom and a relatively short boom or boomlet which collectively comprise a generally horizontally extending elongated sail positioning structure rotationally connected to the mast. The sail head is connected to the mast and the clew to the sail positioning structure at a point thereof which is remote from the mast, namely, the free end of the boom. The sail tack is secured to the sail positioning structure at a point which is offset from the mast in a direction normal to the longitudinal extent of the sail positioning structure thereby to create the described slot effect between the mast and the luff of the sail. This positioning of the tack of the sail is achieved in FIG. 8 by connecting the tack to the end of the long boom adjacent its connection to the short boom and, in FIG. 12, by connecting the tack to the end of the short boom that is remote from the mast.

THIRD VARIATION OF THE PREFERRED EMBODIMENT

Even greater sail lift may be achieved by employing a composite airfoil sail in which the individual sails of a pair are mounted in overlaying relationship and are adjusted, by means of clew outhauls, to form a semi-rigid, yet controllable, airfoil envelope. Airfoil sails which have thickness are more efficient than those sails comprised of single thin sheets. However, theretofore, such airfoil sails have been heavy, cumbersome, unadjustable for shape, etc.

Figure 15:
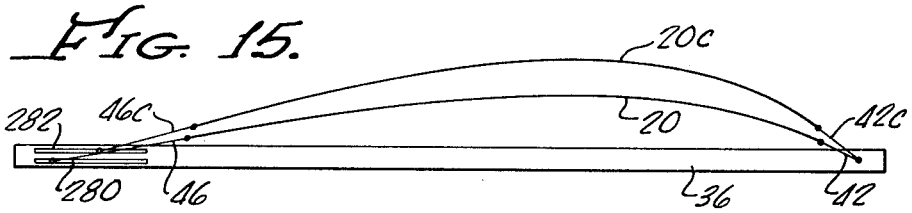
FIG. 15 is a horizontal sectional view showing a pair of overlaying sails mounted to form an airfoil envelope.

Referring to FIG. 15, a composite airfoil sail is formed of substantially identical first sail and second sails 20 and 20c which are attached to the same support structure, for example the tripod mast and the spar 36 of FIG. 1, in overlaying relationship. The luff cables 42, 42c are attached to substantially the same point at the forward end of the spar 36 and the leech cables 46, 46c are respectively attached to separate clew outhaul means 280, 282, each of which may comprise a conventional sail track, to which the sail clews are slidable connected, mounted on the upper surface of the spar 36, or which may be similar to the clew outhaul means 54 previously described.

The lower end of the leech cable 46c of the outermost sail 20c (referred to the longitudinal axis of the craft on which the sail is mounted) is positioned forwardly, on the spar 36, of the lower end of the leech cable 46 of the innermost sail 20. The outermost sail is thereby caused to assume a deeper curvature than that of the innermost sail 20 in the manner previously described. A sail with substantial thickness is thereby created which resembles, in cross section, an airplane wing or cambered airfoil, the outermost sail 20c corresponding to the more curved upper surface of the wing and the innermost sail 20 corresponding to the less curved lower surface of the wing.

In operation, the shape and thickness of the composite airfoil sail, formed of the sails 20, 20c, is varied by moving lower ends of the leech cables 46, 46c relative to each other. The composite sail may be made thicker or thinner, as may be desired for optimum lift, for example by moving the lower end of the cable 46c forwardly away from or rearwardly towards the lower end of the cable 46. When the craft is put about so that the sail 20c becomes the innermost sail and the sail 20 becomes the outermost sail, the lower end positions of the cables 46, 46c are reversed in order that the sail may have the same shape on the new heading. Such position reversal may be accomplished by individually repositioning the cable ends on the outhaul means 280, 282. Alternatively, toggle means, not shown, may be used to reverse the relative positioning of the ends of the cables 46, 46c by moving both cable ends in unison. Sailing of the craft is otherwise as described in the preferred embodiment.

It will be seen that the method of sailing with the composite airfoil sail of FIG. 15 includes the steps of joining a sail with a substantially identical second sail along the luffs of both said sails, with the leech of both said sails in close adjacency, and inducing an airfoil at the outermost of said sails having a greater degree of curvature than that of the innermost of said sails, whereby an airfoil envelope is formed having substantial thickness in portions thereof.

Such a composite sail is applicable to the preferred embodiment and to the described variations thereof, and also is applicable to other types of sails such as jibs and stay sails.

EXAMPLE OF SAIL LUFF AND LEECH CURVES: DERIVATION FROM EQUATION (1)

The following example is given by way of illustration, no limitation being thereby intended or implied. Starting with the previously described general equation (1) for the deflection of a ramp loaded cable, a luff curve equation:

$$y_{luff} = 2.17 \times 10^{-3}(25x - x^3/25) \quad (2)$$

and a leech curve equation:

$$y_{leech} = 5.3 \times 10^{-3}(25x - x^3/25) \quad (3)$$

are derived for a sail having a height of 25.0 feet (which is used in place of the non-vertical luff chord length of 25.5 feet and the straight line leech length of 25.5 feet) and a foot chord length, *b*, of 10.0 feet. A 3/16, 7 × 19 cable having an $H_L$ of 1000 pounds is assumed, as is a leading angle (of the sail luff to the airfoil chord) of 25.6°. A forward sail force, F, is assumed to be 54.5 pounds and a side sail force, S, is assumed to be 105 pounds (FIG. 14). An $H_T$ of 513 pounds is assumed. (subscript L refers to the leading edge, or luff; T to the trailing edge, or leach).

W is obtained in the following manner. Referring to FIG. 14, there is a loading on the luff (leading) cable of $W_L$ and on the leech (trailing) cable of $W_T$. $W_L$ and $W_T$ may be resolved into forward and side components $F_L$ and $S_L$, and $F_T$ and $S_T$, respectively, such that the total side force, $S = S_L + S_T = 105$ pounds and the total forward force, $F = F_L - F_T = 54.5$ pounds.

The sail is considered to behave like a jib sail with the center of effort approximately of the distance aft towards the leech edge from the luff, and $S_T = \frac{1}{2} S_L$. Thus $S_L$ equals approximately 70 pounds and $S_T$ equals approximately 35 pounds.

For an angle of attack of 25.6°, and $S_L = 70$ pounds, $W_L = 70$ pounds/(sin 25.6° × 125 square feet) = 1.3 pounds/sq. ft.

Equation (2) is derived by substituting $W_L = 1.3$ pound/sq. ft. and the other constants cited in connection with equation (1).

Similarly, $F_L = 146$ pounds. $F = 54.5$ pounds, thus $F_T$ equals $146 + 54.5 = 200.5$ pounds. $S_T = 35$ pounds. The tangent of the trailing angle is $S_T/F_T$. Therefore, the trailing angle is 9.9° and $W_T = 35/(\sin 9.9° = 125$ square feet) = 1.63 pounds/sq. ft. Substitution of $W_T =$ 1.63 pound/sq. ft. together with the other constants cited, results in equation (3).

The various described elements of the preferred embodiment and its variations are constructed in a conventional manner. The masts 56, 58 and 60 and spar or boom 36 and 36*a, b* are preferably of strong, lightweight tubular construction employing such materials as aluminum, Fiberglas or stainless steel. The various elements such as stub mast 40, boomlet 208, 208*a* and mast fitting 234 are constructed of a strong corrosion-resistant material such as stainless steel. The various cables are preferably of stranded stainless steel wire. The sail 20 and 20*a, c* are of a conventional sail material such as Dacron. The various bushings for the stub mast fittings are preferably of a type requiring no lubrication.

The preferred embodiment illustrates a triangular mainsail attached or supported only from its corners and having countertensioned luff and leech edges and a sail-shaping batten. It is to be appreciated, however, that other types of sails are also included within the scope of the invention. Use of countertensioned edges and sail-shaping battens may be applied, for example, to rectangular mainsails, or to auxilliary sails such as jib sails. The foregoing description of the preferred embodiment and the variations thereof are to be clearly understood as given by way of illustration and example only, the spirit and scope of the invention being limited solely by the appended claims.

I claim:

1. A high efficiency aerodynamic sail system, comprising:

a. a sail having a luff, a leech, a head and a foot,
 said sail having a center of area at, or below, mid-height, b. means for supporting said sail,
 said supporting means being adapted to suspend said sail from every corner,
 said supporting means being adapted for mounting on a sailing craft,
 said supporting means including means to adjust the angle between said sail and said sailing craft while sailing, and to maintain said angle independently of the strength of the incident wind, c. means for causing the luff-to-leech airfoil chords of said sail to be virtually parallel each with the others when said sail is generating an aerodynamic lift force,
 said means for causing the luff-to-leech airfoil chords of said sail to be virtually parallel with each other when said sail is generating an aerodynamic lift force being capable of adjustment while said sail is in use, and, d. means for connecting said sail to said means for matching the leeward deflections of said luff and leech.

2. The aerodynamic sail system of claim 1 wherein said means for causing the luff-to-leech airfoil chords of said sail to be virtually parallel with each other when said sail is generating an aerodynamic lift force includes restricting means for restricting the deflections of both said luff and leech.

3. The aerodynamic sail system of claim 2 wherein the connecting means include pockets along said luff and said leech of said sail means,
 said pockets enclosing portions of said restricting means, and further wherein the said connecting means may also include conventional tightening means at said head, tack and clew whereby folds and wrinkles are prevented.

4. The aerodynamic sail system of claim 2 including attaching means for attaching said restricting means to said supporting means,
 said attaching means being located generally in proximity to said head, tack, and clew of said sail, and hereinafter designated after the corner of said sail in closest proximity, for example: peak attaching means being said attaching means connected to leech said restricting means in proximity to said head of said sail, for a sail of generally trapezoidal shape.

5. The aerodynamic sail system of claim 4 wherein said supporting means includes means allowing an undisturbed flow of air onto said luff.

6. The aerodynamic sail system of claim 5 wherein said means allowing said undisturbed flow of air onto said luff includes a short boom adapted for rotational mounting on a mast,
 said head of said sail being adapted to hand from said mast, the tack attaching means being attached to the free end of said short boom, said short boom being movable to position said luff free of the wake of said mast by rotation through at least a half-circle, said rotation being in the direction to cause said luff to pass abaft of said mast.

7. The aerodynamic sail system of claim 6 wherein said means for supporting said sail further includes a long boom having one end adapted for rotational mounting on said mast generally below said short boom,
 the clew attaching means being attached to the free end of said long boom.

8. The aerodynamic sail system of claim 7 including a rotatable streamlined fairing sleeve adapted to enclose a portion of said mast adjacent to said sail whereby mast drag is reduced,
 said booms being movable to position said sail aweather of said mast to create a slot effect between said mast and said sail whereby said lift is increased.

9. The aerodynamic sail system of claim 6 wherein said means for supporting said sail further includes a long boom having an end pivotally attached to said free end of said short boom,
 the clew attaching means being attached to the free end of said long boom.

10. The aerodynamic sail system of claim 9 including a rotatable streamlined fairing sleeve adapted to enclose a portion of said mast adjacent to said sail whereby mast drag is reduced,
 said booms being movable to position said sail aweather of said mast to create a slot effect between said mast and said sail whereby said lift is increased.

11. The aerodynamic sail system of claim 1, wherein said sail comprises first and second sails in overlaying relationship, said first and second sails each having individual means for controlling camber, whereby the shape of each said first and second sails may be separately adjusted to form an airfoil envelope having a smoothly variable substantial thickness by causing said sail to windward to have a lesser camber and longer chord than said sail to leeward, on either tack; it being understood that a portion of said sail to windward may project beyond said sail to leeward.

12. The aerodynamic sail system of claim 1 wherein said sail includes at least one batten pocket and a sail-shaping batten adapted to fit into each said batten pocket.

13. The aerodynamic sail system of claim 12 wherein said sail-shaping batten has a longitudinally varying cross section to cause, when laterally flexed, bending thereof into the outline of an optimum airfoil.

14. The aerodynamic sail system of claim 12 wherein ends of said batten are connected to said means for causing the luff-to-leech airfoil chords of said sail, to be virtually parallel with each other when said sail is generating an aerodynamic lift force for causing a constant angle of said sail attack.

15. The aerodynamic sail system of claim 1 wherein the shape of said luff when lofted and the deflection curve of said luff at one condition of sailing are related each to the other, and the shape of said leech when lofted and the deflection curve of said leech at the said condition of sailing are also related each to the other, both said luff and leech lofted shapes also being related each to the other, whereby the camber of said sail may be caused to follow a predetermined relationship with elevation at said condition of sailing.

16. The aerodynamic sail system of claim 15 wherein said luff and leech shapes are both cut to inward curves.

17. The aerodynamic sail system of claim 15 wherein the said predetermined relationship of said camber to said elevation is such that said camber is substantially constant along the entire height of said sail.

18. The aerodynamic sail system of claim 15 wherein the said predetermined relationship of said camber to said elevation is such that said camber aloft is less than said camber below, to compensate for greater wind-speeds commonly encountered aloft under certain atmospheric conditions.

19. An aerodynamic sail system comprising:

a sail having a head and a foot, said foot having tack and clew corners, means for supporting said head aloft, said means including a generally vertically extending mast, and further including means for securing said head to said mast, means for positioning said sail with respect to the wind, said positioning means including means for downhauling said sail to change the vertical curvature of said sail, means for attaching said foot to said positioning means, said means including tack and clew attaching means, and means for outhauling said foot to change the horizontal curvature of said sail wherein said outhauling means includes an arcuate track connected to said positioning means and a movable trolley connected to the end of one said luff or leech attaching means, said trolley being adapted to slide along said arcuate track whereby the distance between said luff and leech may be varied without affecting the distances between said head and said tack and between said head and said clew, and the said vertical curvatures of said sail.

20. A high efficiency aerodynamic lift-generating sail system, comprising:

a. at least one generally triangular sail having a luff, a leech, a head, a tack, a clew and a foot, and having a batten pocket along said foot, b. means for supporting said sail at said head, tack and clew, with said luff away from the wake of any supporting structure, said supporting means being adapted for attachment to a sailing craft, c. means for matching the leeward deflections of said luff and leech whereby a virtually constant angle of attack of sail chords to the wind is provided along the height of said sail, said means including adjustable luff and leech countertension elements connected to said luff and said leech of said sail, said countertension elements acting in concert to move said luff and leech generally apart against the inwardly-directed tensile forces in said sail, d. an elongate sail-shaping batten adapted to fit in said batten pocket and having ends adapted for attaching to said luff and leech countertension elements, said batten having a longitudinally varying cross section whereby when said batten is laterally flexed it bends into an outline of an optimum airfoil, and, e. means for adjusting and maintaining the magnitude of said angle of attack independently of the velocity of said wind.

21. The aerodynamic sail system of claim 20 wherein said luff and leech of said sail are cut in an inward curve in proportion to deflection curves of said luff and leech countertension elements for at least one sailing condition.

22. The aerodynamic sail system of claim 21 wherein lower ends of said luff and leech countertension elements are attached to said supporting means, said lower end of said luff and leech countertension elements being movably attached to said supporting structure whereby the distance between said luff and leech may be varied without directly affecting the relationship of said leeward deflections thereof.

23. An aerodynamic sail system comprising:

at least one generally triangular sail having a luff, a leech, a head and a foot, said foot having a tack and a clew, means for supporting said sail at said head and foot with said luff away from the wake of any supporting structure, said supporting means being adapted for attachment to a sail-powered craft, said supporting means including a streamlined mast, said supporting means also including a short boom having an end pivotally mounted to said mast, said supporting means further including a long boom having one end pivotally mounted to said mast, said head being adapted to hang from said mast, said clew being adapted to connect to the free end of said long boom, said long boom being rotatable to position said sail with respect to the wind whereby said sail generates lift, and, said tack being adapted to connect to the free end of said short boom, said short boom being rotatable to position said luff away from the wake of said mast and to position said sail abreast of and to the weather side of said mast to create a slot effect between said mast and said sail to increase said lift, said rotation of said short boom being in the direction to move said luff around to the rear of said mast when changing tacks.

24. A high efficiency aerodynamic sail system, comprising:

a. at least one generally triangular sail having a luff, a leech, a foot, a tack and a clew, b. means for supporting said sail by said head and said tack and said clew, said supporting means being adapted for attachment to a sailboat, c. means for outwardly tensioning said luff and said leech of said sail, including a tension element, one portion thereof being attached along said luff and another portion thereof being attached along said leech, ends of said tension element being attached to a portion of said supporting means to support said tack and clew of said sail, one of said tension element ends adjacent to said clew being slidably attached to an arcuate track on said supporting means, said track having a radius of curvature to said head of said sail, whereby said tension element end adjacent to said clew may be moved toward or away from the other said end thereof which is adjacent to said tack without directly affecting the tension of said tension element, and d. means for causing said sail to assume an optimum airfoil shape, including an elongate batten having a longitudinally varying cross section, said batten being installed along said sail foot and having ends thereof attached to opposite ends of said tension element.

25. The aerodynamic sail system of claim 24 wherein said tensioning means includes means for pulling downwardly that portion of said supporting means to which said ends of said tension element are attached.

26. The aerodynamic sail system of claim 25 wherein said supporting means includes a mast structure having three inclined masts meeting at a common point from which said sail head is suspended, and a spar having said tack and clew of said sail attached to opposite ends thereof.

27. The aerodynamic sail system of claim 26 including a stub mast, said spar being rotatably connected thereto.

28. The aerodynamic sail system of claim 25 wherein said supporting means includes a single mast for supporting said head of said sail, a short boom having a first end rotatably attached to said mast and a long boom having a first end pivotally attached to a second end of said short boom, said tack of said sail being attached to said first end of said long boom and said clew of said sail being attached to said second end of said long boom.

29. The aerodynamic sail system of claim 25 wherein said supporting means includes a single mast supporting said head of said sail, a short boom having a first end rotatably attached to said mast and a long boom having a first end rotatably attached to said mast, said tack of said sail being attached to a second end of said short boom and said clew of said sail being attached to a second end of said long boom.

30. The aerodynamic sail system of claim 29 wherein rotation of said short boom about said mast causes outhauling of said tack of said sail.

31. A method for making and using a sail, comprising the steps of:

a. providing a flexible sail capable of assuming a smooth continuous airfoil shape in cross section responsive to the flow of air along its surfaces, b. providing deflection control elements for at least the luff and leech of said sail to oppose the tendency of said sail to belly greatly to leeward, said deflection control elements each having substantially the same characteristic taken laterally to a chord drawn across the foot of said sail, c. providing twist control elements for changing the magnitudes of lateral deflection of said luff and leech with respect to each other, d. connecting said deflection elements to said luff and leech, e. connecting said twist control elements to said deflection control elements, f. positioning said sail in respect to the wind to create a sail lift force, and, g. adjusting said twist control elements until the lateral components of deflection of said luff and leech are substantially matched along lines of airflow.

32. The method of claim 31 including additional steps:

a. calculating or measuring the longitudinal components of deflection of said luff and leech for at least one condition of said airflow, b. from the data accumulated in step 32(a), calculating the longitudinal spacings between said luff and said leech at several elevations along the height of said sail, c. calculating or measuring the lengths of the surface of said sail from said luff to said leech, taken along the lines of said airflow at the said several elevations, d. calculating the ratios of airfoil chord length calculated in step 32(b) to the respective arc lengths at the same said elevations accumulated in step 32(c), whereby the said ratios indicate the camber to be found at the said several elevations, e. tabulating the variations of said ratios along said height of said sail, f. changing the outline shape of said sail, or the longitudinal deflection characteristics of said deflection control elements, or both, and again performing steps 32(a) through 32(f) as necessary until said variation or ratios agrees with the desired variation of camber along the said height of said sail, it being understood that the said ratios are inversely proportional to said cambers, being related by the said airfoil shape, g. providing camber control elements for changing said longitudinal spacings, h. connecting said camber control elements to at least one said deflection control element, and, p1 i. adjusting said camber control element for the desired camber at said condition of said airflow.

33. The method of claim 32 wherein the said ratios increase with said elevation whereby said camber is reduced aloft to compensate for stronger winds at greater said elevations.

34. The method of claim 32 wherein the said ratios are equal, to provide a sail having a substantially constant camber.

35. The method of claim 32 wherein the said luff and said leech are cut inwardly in curves responsive to the curves of total deflection of said deflection control elements.

36. The method of claim 31 wherein said step of positioning said sail recited in clause 31(f) includes locating the center of sail lift adjacent to and upwind of a supporting structure, thereby increasing said lift by creation of a slot effect between said sail and said supporting structure.

37. The method of claim 36 including the step of installing a rotatable streamlined fairing sleeve around said supporting structure to reduce drag and preserve laminar said airflow.

38. The method of claim 31 including the steps of overlaying said sail with a substantially identical second sail with the luff of both said sails in close adjacency, and inducing an airfoil at the outermost of said sails having a greater degree of curvature than that of the innermost of said sails, whereby an airflow envelope is formed having substantial thickness in portions thereof.

39. The method of claim 31 including the steps of joining said sail with a substantially identical second sail along the luffs of both said sails, with the leech of both said sails in close adjacency, and inducing an airfoil at the outermost of said sails having a greater degree of curvature than that of the innermost of said sails, whereby an airfoil envelope is formed having substantial thickness in portions thereof.

* * * * *